US005535697A

United States Patent [19]

Akahira

[11] Patent Number: 5,535,697

[45] Date of Patent: Jul. 16, 1996

[54] TUBE FOR A RUBBER BOAT AND METHOD OF FABRICATION THEREOF

[75] Inventor: Kaoru Akahira, Toyota, Japan

[73] Assignee: Toyota Jidosha Kabushiki Kaisha, Toyota, Japan

[21] Appl. No.: 391,004

[22] Filed: Feb. 21, 1995

[30] Foreign Application Priority Data

Jun. 14, 1994 [JP] Japan ..... 6-132092

[51] Int. Cl.[6] ..... B63B 7/00

[52] U.S. Cl. ..... 114/345; 114/357

[58] Field of Search ..... 114/65 R, 345, 114/355, 357; 441/40

[56] References Cited

U.S. PATENT DOCUMENTS

| | | | |
|---|---|---|---|
| 2,508,304 | 5/1950 | Sturtevant | 114/345 |
| 3,030,640 | 4/1962 | Gosman | 441/40 |
| 3,930,274 | 1/1976 | Syfritt | 114/345 |

FOREIGN PATENT DOCUMENTS

| | | | |
|---|---|---|---|
| 2549797 | 2/1985 | France | 114/345 |
| 3-20238 | 4/1991 | Japan . | |
| 646498 | 11/1950 | United Kingdom . | |

*Primary Examiner*—Stephen Avila
*Attorney, Agent, or Firm*—Cushman, Darby & Cushman

[57] ABSTRACT

A tube for a rubber boat which is provided at a periphery of the rubber boat and whose intended expanded configuration having a three-dimensional curve as a central line is a substantially cylindrical configuration. A fabricated configuration of the tube for the rubber boat is a substantially equilateral polygonal column configuration formed by preparing equilateral polygons which are the same as circumferential lengths of the intended expanded configuration in a plurality of cross-sections orthogonal to the central line, and for each of which distances from respective vertices thereof to the central line are equal, and by connecting corresponding sides of equilateral polygons of adjacent orthogonal cross-sections among the plurality of orthogonal cross-sections. For each equilateral polygon forming the substantially equilateral polygonal column configuration, a sum total of lengths of respective sides of any given equilateral polygon is substantially equal to a circumferential length of the intended expanded configuration in an orthogonal cross-section including the given equilateral polygon. Therefore, when the tube is expanded, a substantially cylindrical tube for a rubber boat can be obtained in which the substantially equilateral polygonal column configuration has substantially a same diameter as a diameter of an intended substantially cylindrical configuration.

24 Claims, 10 Drawing Sheets

TUBE FOR A RUBBER BOAT AND METHOD OF FABRICATION THEREOF

BACKGROUND OF THE INVENTION

1. Field of the Invention

The present invention relates to a tube for a rubber boat which is provided at the side portions of a rubber boat and whose intended expanded configuration is a substantially cylindrical configuration having a predetermined three-dimensional curve as the central line thereof, and to a method of fabricating the tube for a rubber boat.

2. Description of the Related Art

Generally, rubber boats are formed by a boat main body which is made of rubber, a boat bottom which is installed at a bottom portion of the boat main body, and the like. The boat main body includes the bottom portion, at which the boat bottom is installed, and expanding tubes, which are provided at the side portions of the bottom portion and which provide buoyancy.

The tubes are formed on the whole as substantial cylinders, but are not formed as straight cylinders. Namely, the portions of the tubes which form the side portions of the bottom portion are substantial parallel cylinders which run along the keel line, but toward the bow, the tubes are provided in tapered configurations which gradually curve toward the keel line.

In general, there are two methods of fabricating such tubes. In the first method of fabrication, a plurality of cylindrical tube elements and truncated cone-shaped elements are prepared, and these elements are successively connected together. This first method of fabrication is the more frequently used method. In the second method of fabrication, two sheet materials are readied and fit together. In this state, the sheet materials are cut into predetermined curved configurations, and are then adhered together. This second method of fabrication is used for small rubber boats having flat bottoms.

However, the work involved in the first method of fabrication is complex as the cylindrical tube elements and the truncated cone-shaped tube elements must be successively connected together. Further, when the tubes are expanded, there are folds at the connections of the respective elements at portions toward the bow, and accordingly, the quality of tile external appearance deteriorates. In the second method of fabrication, tubes having a good external appearance which curve smoothly are obtained. However, there is a drawback in that only a two-dimensional curved configuration can be realized (the tubes are of configurations which curve when viewed from above, but do not curve when viewed from the sides).

In recent years, rubber boats for improving the ability to ride over waves and seaworthiness, which rubber boats have a three-dimensional boat body configuration, have been used. Accordingly, tubes having configurations which curve three-dimensionally (configurations which curve when viewed from above and from the sides) are necessary. In this case, the first method of fabrication can be used, but, as mentioned above, the operations involved therein are complex and the external appearance of the boat deteriorates.

SUMMARY OF THE INVENTION

In view of the aforementioned, an object of the present invention is to provide a tube for a rubber boat and a method of fabrication thereof in which a three-dimensional curved configuration can be realized and in which workability and the quality of the external appearance can be improved.

The first aspect of the present invention is a tube for a rubber boat which is provided at the periphery of a rubber boat and whose intended expanded configuration having a three-dimensional curve as a central line is a substantially cylindrical configuration, wherein a fabricated configuration of the tube for a rubber boat is a substantially equilateral polygonal column configuration formed by preparing equilateral polygons which are the same as circumferential lengths of the intended expanded configuration in a plurality of cross-sections orthogonal to the central line, and for each of which distances from the respective vertices thereof to the central line are equal, and by connecting corresponding sides of equilateral polygons of adjacent orthogonal cross-sections among the plurality of orthogonal cross-sections.

The second aspect of the present invention is a method for fabricating a tube for a rubber boat comprising the steps of: preparing a jig in which a plurality of ridge lines of a substantially equilateral polygonal column configuration is reproduced, for a tube for a rubber boat which is provided at the periphery of a rubber boat and whose intended expanded configuration having a three-dimensional curve as a central line is a substantially cylindrical configuration and whose fabricated configuration is the substantially equilateral polygonal column configuration formed by preparing equilateral polygons which are the same as circumferential lengths of the intended expanded configuration in a plurality of cross-sections orthogonal to the central line, and for each of which distances from the respective vertices thereof to the central line are equal, and by connecting corresponding sides of equilateral polygons of adjacent orthogonal cross-sections among the plurality of orthogonal cross-sections; forming cutting patterns for a plurality of sheet members which respectively correspond to a plurality of surfaces forming the tube for a rubber boat by placing a flexible plate member at each surface of a plurality of surfaces which respectively are formed by connecting a pair of adjacent ridge lines among the plurality of ridge lines of the jig; cutting the plurality of sheet members from a sheet material by using the cutting patterns for the plurality of sheet members; and adhering the plurality of sheet members together.

The third aspect of the present invention is a jig for fabricating cutting patterns for a tube which cutting patterns are used in fabricating a tube for a rubber boat which tube is provided at the periphery of a rubber boat and whose intended expanded configuration having a three-dimensional curve as a central line is a substantially cylindrical configuration, wherein a fabricated configuration of the tube for a rubber boat is a substantially equilateral polygonal column configuration formed by preparing equilateral polygons which are the same as circumferential lengths of the intended expanded configuration in a plurality of cross-sections orthogonal to the central line, and for each of which distances from the respective vertices thereof to the central line are equal, and by connecting corresponding sides of equilateral polygons of adjacent orthogonal cross-sections among the plurality of orthogonal cross-sections, wherein the jig has supporting bodies which follow substantially the same loci as ridge lines of the substantially equilateral polygonal column configuration.

The fourth aspect of the present invention is a method for fabricating cutting patterns for a tube comprising the steps of: preparing a jig in which a plurality of ridge lines of a substantially equilateral polygonal column configuration is reproduced, for a tube for a rubber boat which is provided at the periphery of a rubber boat and whose intended expanded configuration having a three-dimensional curve as a central line is a substantially cylindrical configuration and whose fabricated configuration is the substantially equilateral polygonal column configuration formed by preparing equilateral polygons which are the same as circumferential lengths of the intended expanded configuration in a plurality of cross-sections orthogonal to the central line, and for each of which distances from the respective vertices thereof to the central line are equal, and by connecting corresponding sides of equilateral polygons of adjacent orthogonal cross-sections among the plurality of orthogonal cross-sections; and copying configurations of respective surfaces of a plurality of surfaces, which are respectively formed by connecting a pair of adjacent ridge lines of the plurality of ridge lines, onto the plate members so as to form cutting patterns corresponding to respective surfaces of a plurality of surfaces forming the tube, by placing flexible plate members at the respective surfaces of the plurality of surfaces respectively formed by connecting a pair of adjacent ridge lines.

In accordance with the first aspect of the present invention, the plurality of equilateral polygons which form the fabricated configuration of the tube for the rubber boat (the substantially equilateral polygonal column configuration) have in common the central line (the predetermined three-dimensional curve) of the intended expanded configuration (the substantially cylindrical configuration) of the tube for the rubber boat. As a result, when compressed air or the like is fed into the tube for a rubber boat which has been unfolded into a planar form from its collapsed state, the tube for a rubber boat begins to expand along the central line which is the intended, predetermined, three-dimensional curve. As expansion continues, the tube for a rubber boat becomes a substantially equilateral polygonal column configuration. When the tube is expanded even more, it changes into the intended substantially cylindrical configuration.

Namely, in the present invention, for each equilateral polygon forming the substantially equilateral polygonal column configuration, the total sum of the sides thereof is substantially equal to the circumferential length of the intended expanded configuration in an appropriate orthogonal cross-section including that equilateral polygon. Therefore, when more compressed air or the like is fed in after the tube has been expanded to the substantially equilateral polygonal column configuration, the intermediate portions of the sides of the equilateral polygons which portions are positioned at the inner sides of the circumferences expand toward the circumferences, and the vertical angle portions of the equilateral polygons which portions are positioned at the outer sides of the circumferences cave in toward the circumferences. As a result, the substantially equilateral polygonal column configuration changes to a substantially cylindrical configuration having the same diameter as the intended substantially cylindrical configuration. In this way, the substantially cylindrical tube for a rubber boat whose central line is the predetermined three-dimensional curve is obtained.

For the above reasons, in the present invention, there is no complex operation such as that of the conventional fabrication method in which the cylindrical and truncated cone-shaped tube elements are successively connected together. Further, no folds can be seen at such connecting portions.

The distinguishing features of the second, third and fourth aspects of the present invention are the use of a jig in which are reproduced the ridge lines of the substantially equilateral polygonal column configuration which is the fabricated configuration of the tube of the rubber boat of the first aspect. Namely, as described above, the ridge lines of the substantially equilateral polygonal column configuration which is the fabricated configuration are reproduced at the jig, and flexible plate members are spread onto the respective surfaces of the jig. Accordingly, in the state in which a plate member is spread on the jig, a quadric surface including a pair of the ridge lines is reproduced by the plate member as a surface which can be spread out. Then, in this state, the edge lines including the pair of ridge lines are copied onto the plate member. Subsequently, the plate member is removed from the jig and is spread out into planar form. A cutting pattern can be obtained by cutting the plate member along the copied line. This operation is carried out for each surface of the jig, so that cutting patterns corresponding to the respective surfaces are obtained. Thereafter, respective sheet members are cut from a sheet material by using these cutting patterns. The resultant sheet members are adhered together so as to have the ridge lines in common. In this way, the tube for a rubber boat having a substantially equilateral polygonal column configuration is fabricated.

As described above, by using the jig in which the ridge lines are reproduced, the complexity involved in a case in which the above-described cutting patterns are formed by using a computer can be avoided. Namely, if cutting patterns are to be obtained by using a computer and not a jig, it is necessary to calculate quadric surfaces from the ridge lines of the substantially equilateral polygonal column configuration, and to calculate planar configurations from these quadric surfaces. However, because the quadric surfaces are torsional surfaces, in actuality, the torsion slightly effects the respective sides of the equilateral polygons at the tip end portion of the tube. In order to remove this effect, it is necessary to calculate the quadric surfaces by imagining the equilateral polygon at infinity or the intersection of the ridge lines at infinity. As a result, complexities are involved such as an extremely long calculation time is necessary and development of software for this particular use is necessary. However, if the jig in which the ridge lines of the substantially equilateral polygonal column configuration are reproduced is used, the quadric surfaces can be reproduced as they are in actuality by spreading the flexible plate members onto the respective surfaces of the jig, and the plate members can be spread out into planar form. Accordingly, the above-mentioned complexities can be avoided.

DESCRIPTION OF THE PREFERRED EMBODIMENT

An embodiment of the present invention will be described in detail hereinafter with reference to FIGS. 1 through 12.

Figure 6:
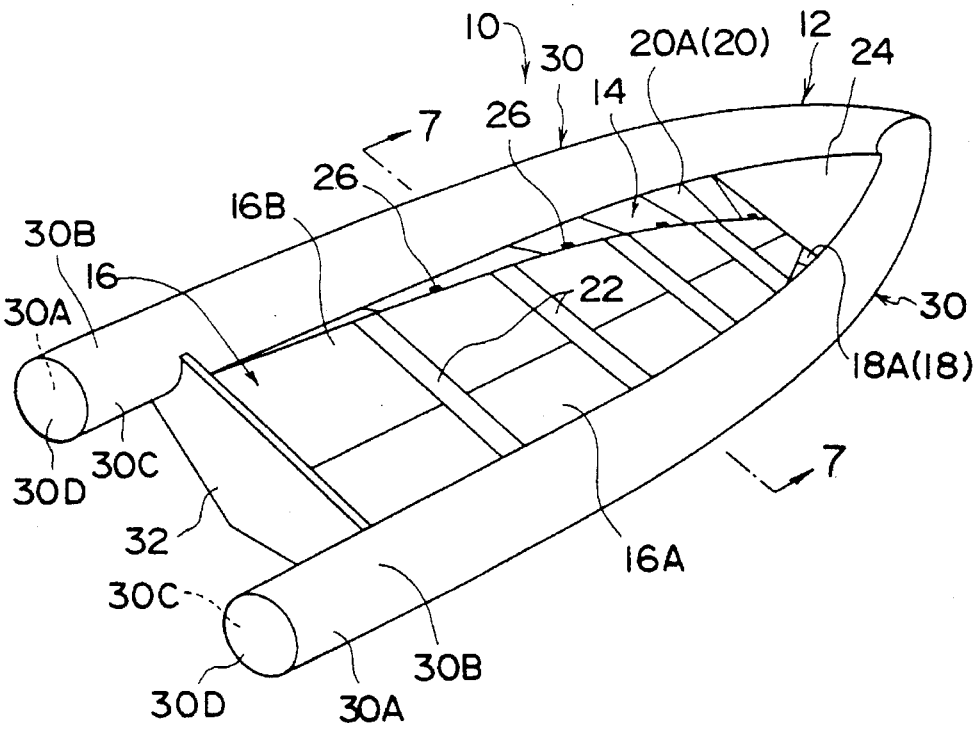
FIG. 6 is a perspective view of a collapsible boat relating to the present embodiment.
Figure 7:
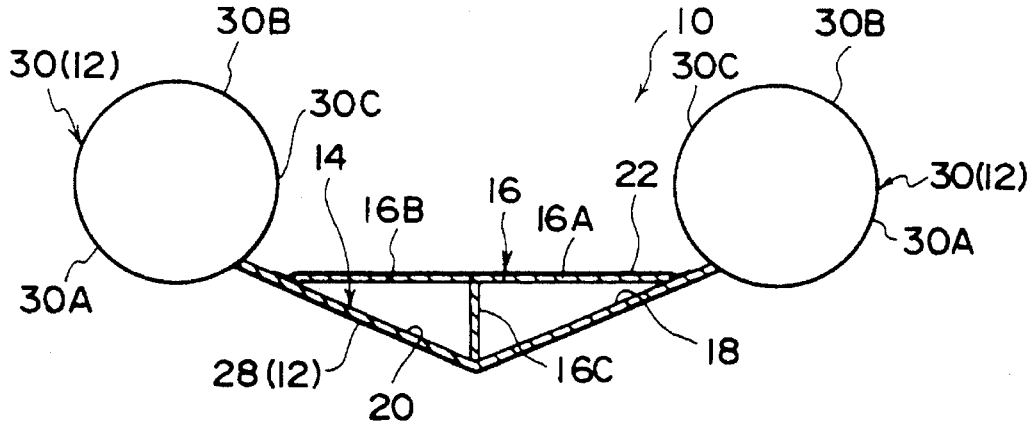
FIG. 7 is a sectional view taken along line 7—7 of FIG. 6.

FIG. 6 is an external perspective view of a collapsible rubber boat 10 relating to the present embodiment. FIG. 7 is a sectional view taken along line 7—7 of FIG. 6. As illustrated in these figures, the rubber boat 10 is structured by the following main structural elements: a boat main body 12, a boat bottom 14 which is installed at the boat main body 12, and a floor member 16 which is fixed to the boat bottom 14.

The floor member 16 is formed of three board members: floorboards 16A, 16B and a keel reinforcing board 16C. The floorboards 16A, 16B are symmetrical to the left and right of the keel reinforcing board 16C, and taper toward the bow. The floorboards 16A, 16B and the keel reinforcing board 16C are connected by hinges at points of intersection of these three board members. Accordingly, the floor member 16 can be folded into a three-layer-stack by the floorboard 16B and the keel reinforcing board 16C being pivoted toward the floorboard 16A.

The boat bottom 14 installed at the floor member 16 is formed by bottom portions 18, 20. Each of the bottom portions 18, 20 is formed as a set of a plurality of panel-shaped bottom portion elements 18A, 20A, which are each formed in a predetermined configuration. The bottom portions 18, 20 are formed so as to be symmetric to the left and the right of the keel line, and can be folded into a two-layer-stack around the keel line. The boat bottom 14 is formed, for example, of FRP. However, steel, aluminum alloy or wood boards can be used for the boat bottom 14 in accordance with the seaworthiness or within an allowed range of weight.

Belts 22 are attached at predetermined intervals in the longitudinal direction of the rubber boat 10 to the bottom portions 18, 20 of the boat bottom 14. The belts 22 are formed of a strong, flexible material (e.g., nylon). Further, a sheet member 24, which is made of the same material as the belts 22, is adhered to the bow side of the boat bottom 14. The ends of the sheet member 24 are folded over onto the reverse surfaces of the bottom portions 18, 20. Accordingly, the boat bottom 14 can be unfolded until the belts 22 and the sheet member 24 are stretched to a predetermined tension. In other words, the belts 22 and the sheet member 24 prevent tile pair of chine lines of the boat bottom 14 from opening beyond the intended positions. Moreover, stoppers 26 are provided at predetermined positions of the surfaces of the bottom portions 18, 20 of the boat bottom 14 (between the points where adjacent belts 22 are attached). When the floor member 16 is attached to the boat bottom 14, the stoppers 26 regulate the movements of the bottom portions 18, 20 of the boat bottom 14 in closing directions.

The boat main body 12, at which the above-described boat bottom 14 is installed, is made of rubber and is formed by a bottom portion 28 and tubes 30 which are provided at the side portions of the bottom portion 28. A transom board 32 which is a hard board is disposed at the stern side of the boat main body 12. An unillustrated outboard may be mounted to the transom board 32.

Next, the tubes 30 of the boat main body 12 will be described in detail.

Figure 1:
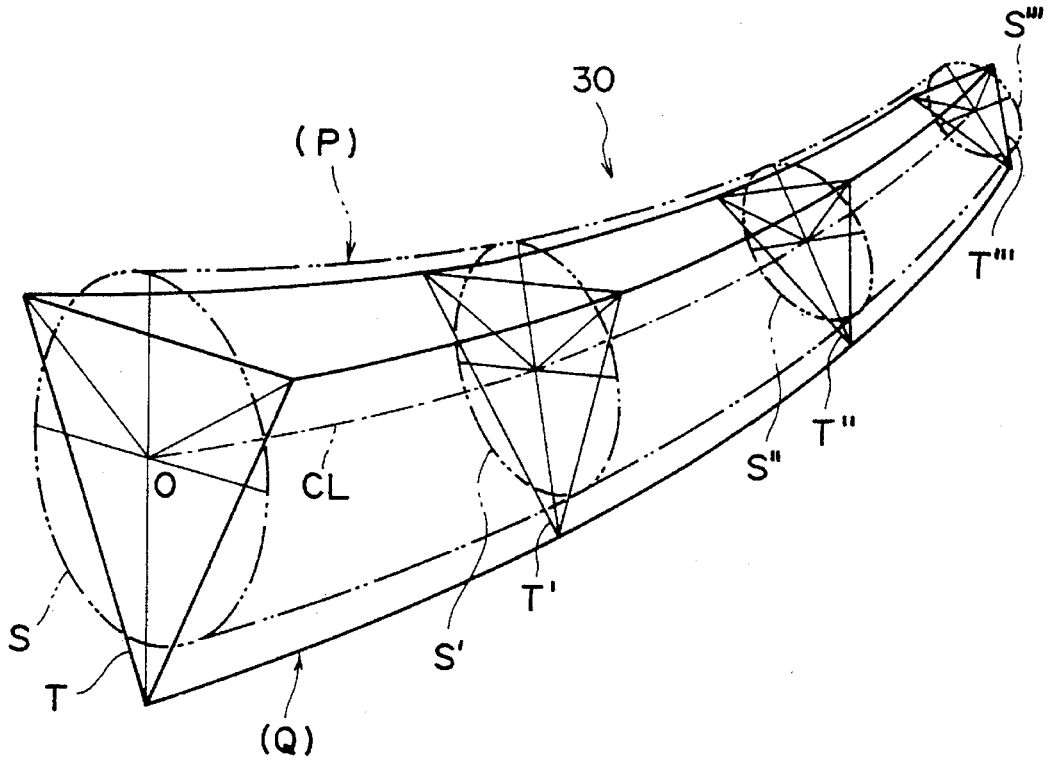
FIG. 1 is a perspective view of a tube of a rubber boat relating to an embodiment of the present invention.
Figure 2:
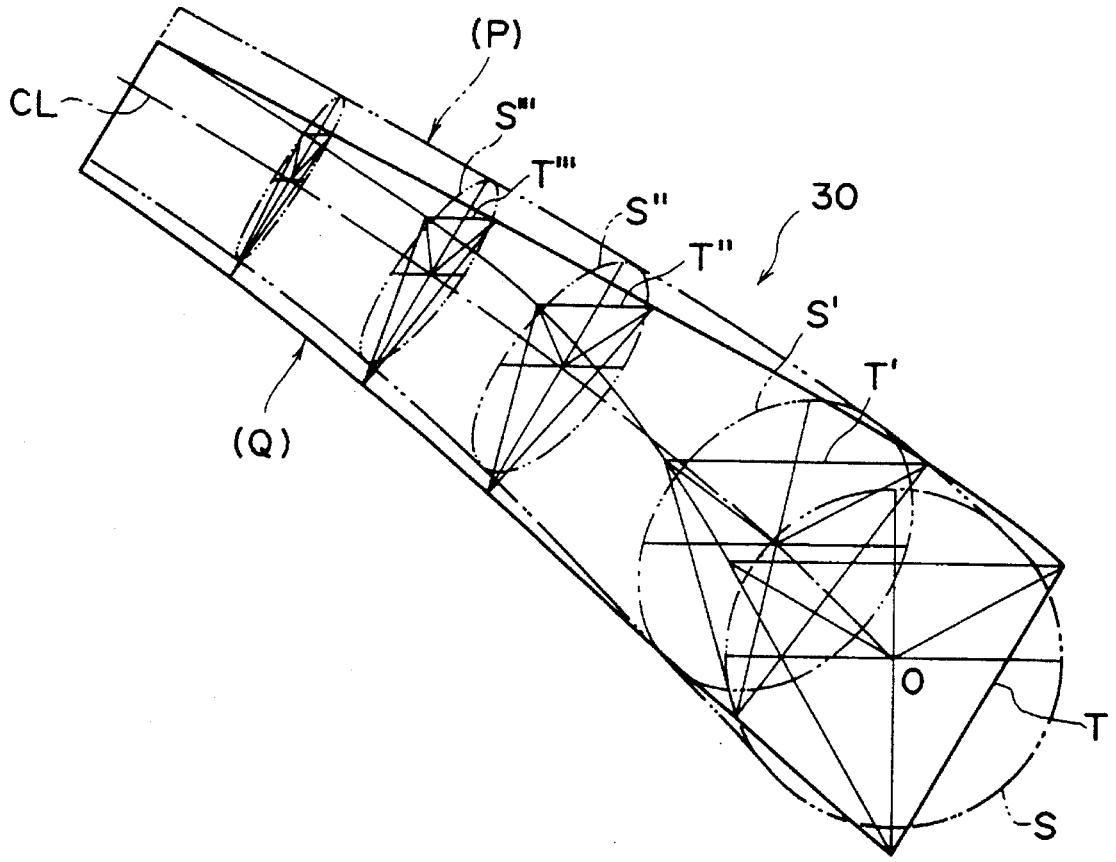
FIG. 2 is a perspective front view of the tube illustrated in FIG. 1.
Figure 3:
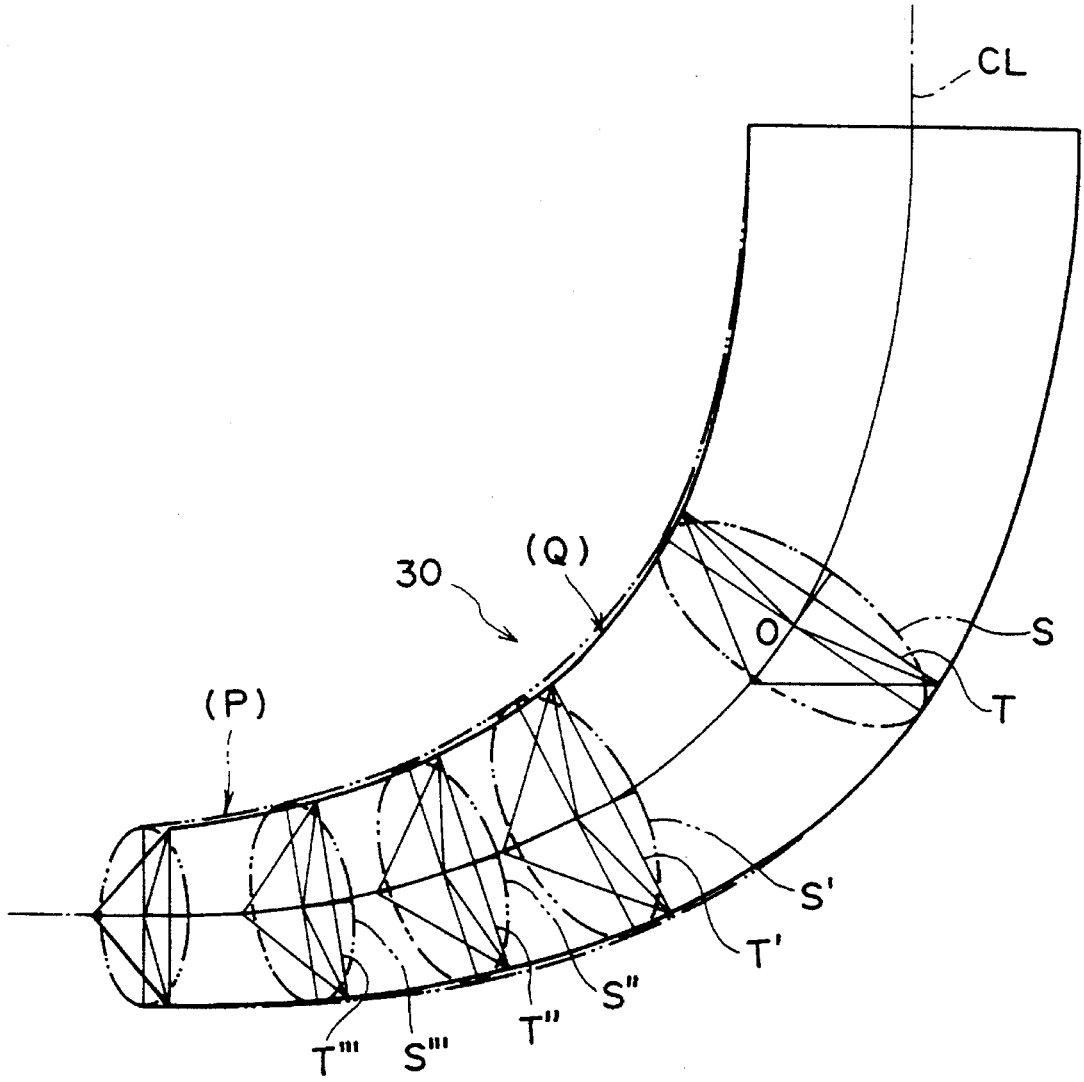
FIG. 3 is a perspective plan view of the tube illustrated in FIG. 1.
Figure 4:
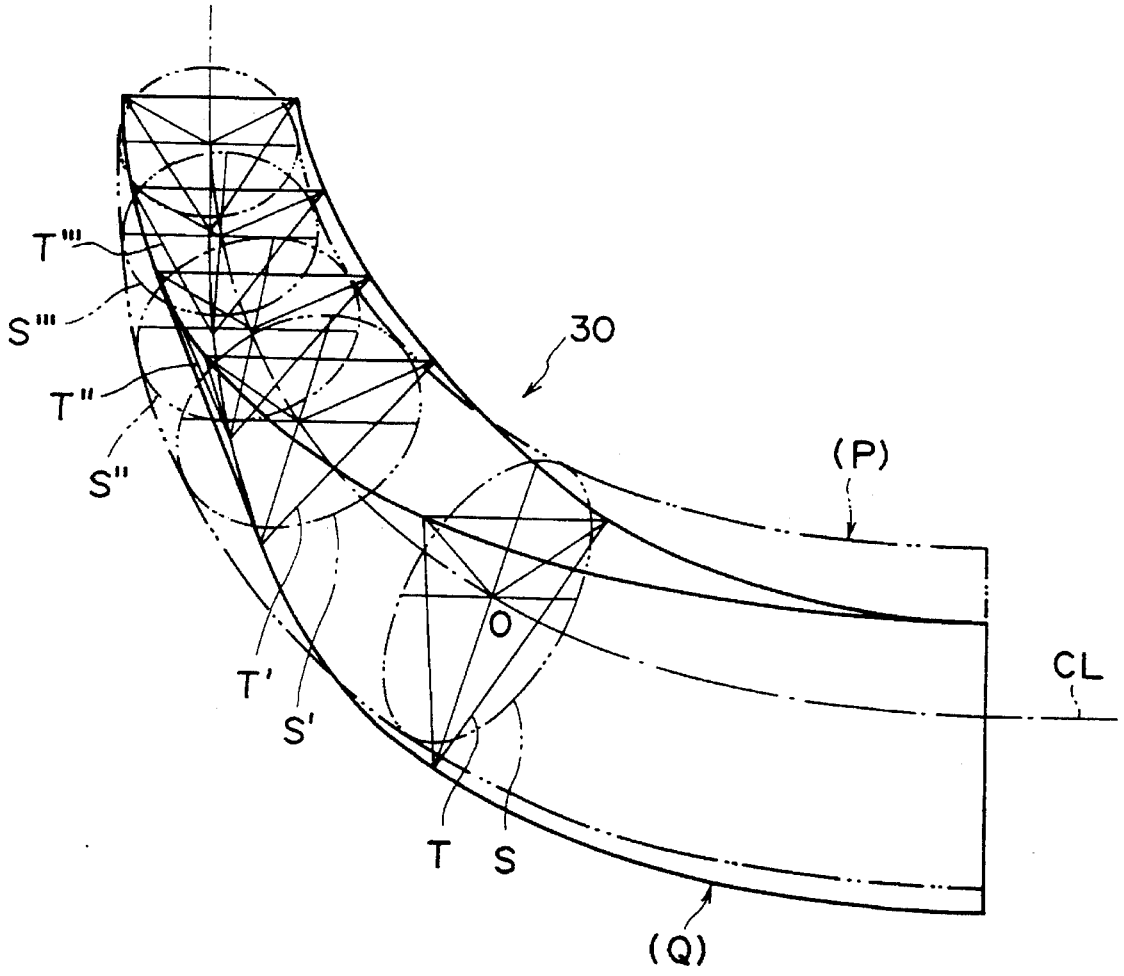
FIG. 4 is a perspective side view of the tube illustrated in FIG. 1.

FIG. 1 is a perspective view of the tube 30 which is disposed at the right side in FIG. 6. FIGS. 2, 3 and 4 are respectively a perspective front view, a perspective plan view and a perspective side view of the tube disposed at the left side in FIG. 6. Hereinafter, the structure of the tube 30 will be described mainly on the basis off FIG. 1.

The single dot chain line in FIG. 1 is a central line CL of the tube 80. The central line CL is a three-dimensional curve which smoothly curves toward the keel line as the central line CL approaches the bow. Accordingly, the central line CL is drawn so as to curve in the perspective front view (illustrated in FIG. 2), the perspective plan view (illustrated in FIG. 3), and the perspective side view (illustrated in FIG. 4).

In FIG. 1, the two dot chain line is the complete intended expanded configuration (P) of the tube 30, and is a substantially cylindrical configuration which runs along the central line CL (more concretely, the intended expanded configuration (P) is a tapered cylindrical configuration whose diameter gradually decreases toward the bow). In contrast, the solid line in FIG. 1 is the fabricated configuration (Q) of the tube 30, and is a substantially equilateral triangular column configuration which shares the central line CL. Accordingly, the tube 30 is formed by connecting together three planar sheet materials 30A, 30B, 30C which are respectively formed in predetermined configurations and which form the substantially equilateral triangular column configuration (see FIG. 6). A circular sheet material 30D serving as a tube closing member is adhered separately to the rear end surface of the tube 30 so as to close the tube 30. The front end surface of the tube 30 is not closed as it is ultimately connected and communicated with the left side tube 30.

Internal pressure may be applied to the tube 30 having the above-described fabricated configuration (Q) (the substantially triangular column configuration) to the extent that the sheet materials 30A, 30B, 30C are not slack. If the tube 30 in this state is expanded even more, the shape thereof changes to the intended expanded configuration (P) (the substantially cylindrical configuration). Namely, both configurations are equivalent. Hereinafter, by using FIG. 5, the reasons why these configurations can be made equivalent as well as the structure (trimming operation) for fabrication which is derived from these reasons will be discussed.

Figure 5:
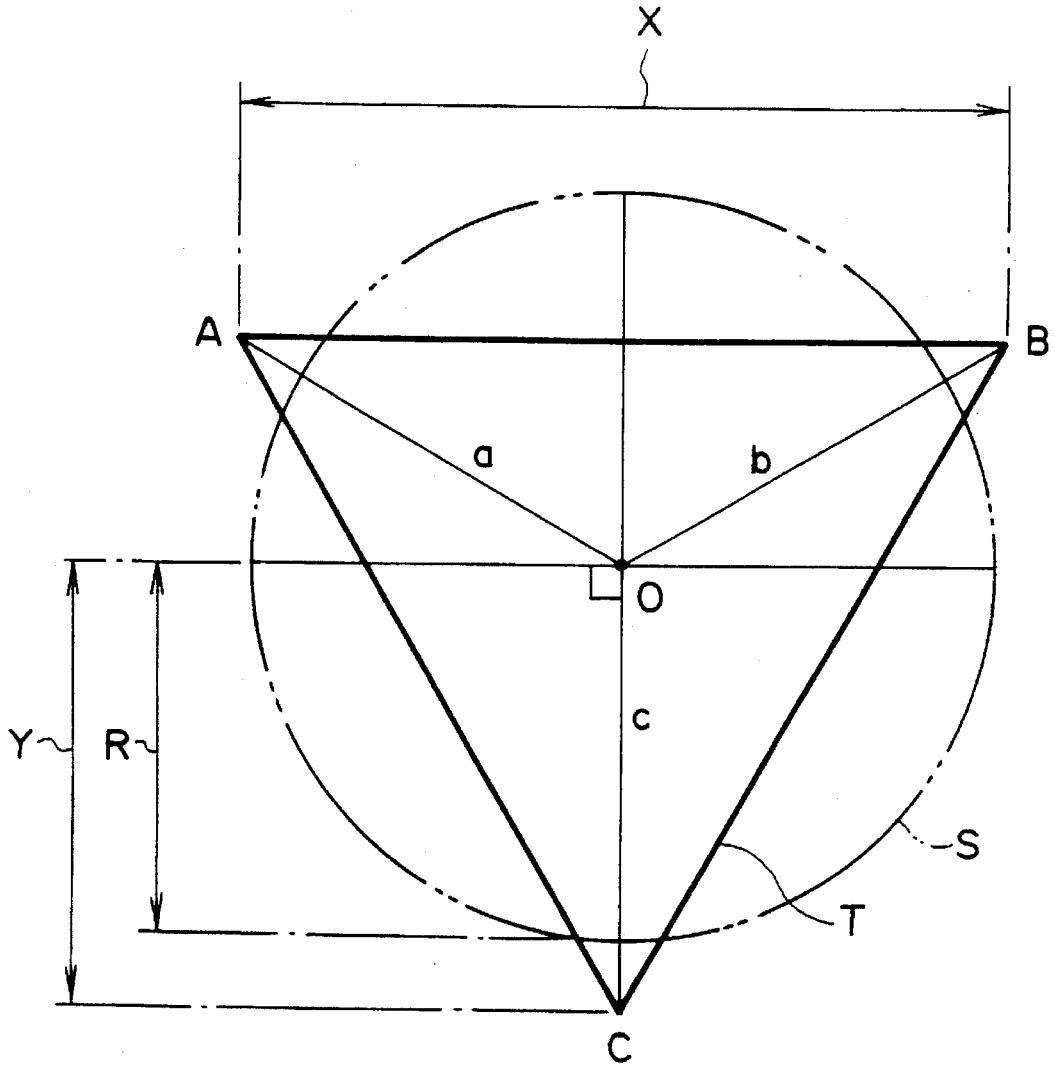
FIG. 5 is an explanatory view illustrating an arbitrary orthogonal cross-section of the tube.

FIG. 5 is an enlarged view of an arbitrary orthogonal cross-section which is orthogonal to the central line CL in FIG. 1. As illustrated in FIG. 5, the circumference S of a circle, which has radius R and whose center O is an arbitrary point on the central line CL, represents a visible outline at an arbitrary orthogonal cross-section of the tube 30 having the intended expanded configuration (P). Accordingly, the circumferential length ($L_1$) of the circumference S is expressed by $L_1=2\pi R$. To facilitate explanation, it is assumed that R=1 (unit circle) in the following description.

An equilateral triangle T having the same length as the circumference S is determined (i.e., an equilateral triangle T which is dimensionally equivalent to the circumference S). Given that the sum total of the lengths of the sides of the equilateral triangle T is $L_2$, the length X of each side is $L_2/3$. Accordingly, because $L_1=L_2$, $X=L_2/3=2\pi/3$. In actuality, when the tube 30 is expanded and deformed from the fabricated configuration (Q) to the intended expanded configuration (P), the sheet materials 30A, 30B, 30C each stretch slightly. Therefore, it is necessary to subtract this elongation percentage $\pi$ (about 3%) in advance. Accordingly, $X=(1-\eta).2\pi/3$.

Next, the lengths of construction lines a, b, c which connect vertices A, B, C of the equilateral triangle T with the center thereof and which are used to determine the coordinates of the equilateral triangle T are determined geometrically. As an example, the length Y of the construction line c is determined as follows: $Y=(1-\eta).\ 2\pi/(3.\sqrt{3})$. An equilateral triangle T having the same center O as the circle having the circumference S is constructed with one side (AB) of the equilateral triangle T being set in the horizontal direction so as to prevent rotation of the subsequently determined equilateral triangles T, T', T''. . . (see FIGS. 1 through 4 ) around the central line CL during construction. Consequently, the resultant equilateral triangle T has a visible outline in the arbitrary orthogonal cross-section of the tube 30 having the fabricated configuration (Q).

In this way, a plurality of arbitrary orthogonal cross-sections which are orthogonal to the central line CL are selected, and equilateral triangles T, T', T'', . . . of the fabricated configuration (Q) are successively constructed from the circumferences S, S', S'', . . . of the intended expanded configuration (P). If the corresponding vertices of the resultant equilateral triangles T, T', T'', . . . are connected and ridge lines are specified, a substantially equilateral triangular column configuration which curves smoothly and three-dimensionally can be obtained.

Hereinafter, operation of the present embodiment will be explained by way of description of the fabrication processes of the tube 30.

In the present embodiment, the fabricated configuration (Q) is an equilateral triangular column configuration. However, the present invention is not limited to the same, and other equilateral polygonal column configurations may be used. In such cases, it is necessary to set the respective equilateral polygons of the arbitrary orthogonal cross-sections such that they do not rotate.

First, the structure of a jig 34 which is necessary during the fabrication of the tube 30 will be described with reference to FIG. 8.

Figure 8:
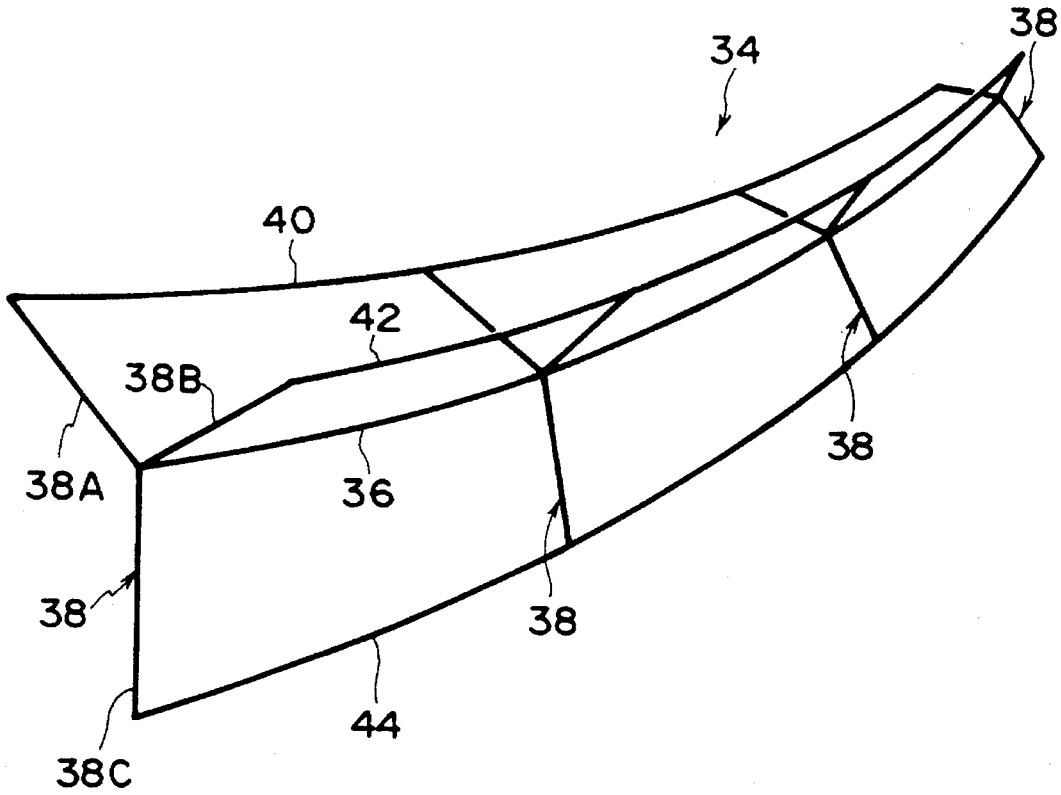
FIG. 8 is a perspective view of a jig used in the fabrication of the tube.

As illustrated in FIG. 8, the jig 34 is provided with a framework which corresponds to the fabricated configuration (Q) of the tube 30 (i.e., a substantially equilateral triangular column configuration). More specifically, the jig 34 has a central shaft 36 which follows the same locus as the central line CL. Ones of end portions of a plurality of supporting bodies 38 (four are shown in the drawing) which are selected as appropriate cross-sections are fixed to predetermined positions of the central shaft 36. Each supporting body 38 is formed of three poles 38A, 38B, 38C which correspond to the three construction lines a, b, c (see FIG. 5) of the equilateral triangle T. Others of end portions (vertices) of supporting bodies 38 which are adjacent in the direction of the central shaft 36 are connected by connecting poles 40, 42, 44. In this way, the three ridge lines of the substantially equilateral triangular column configuration which is the fabricated configuration (Q) are formed. In other words, the jig 34 is a jig in which the three ridge lines are reproduced. Because the tubes 30 are symmetrical to the left and right of the keel line, sheet materials 50 which will be described later can be used for both the left and the right tube 30 provided that the outer and inner surfaces of the tubes 30 are of the same material. Note that the configuration of the jig 34 can be changed appropriately in accordance with the configuration of the tube 30.

Figure 9:
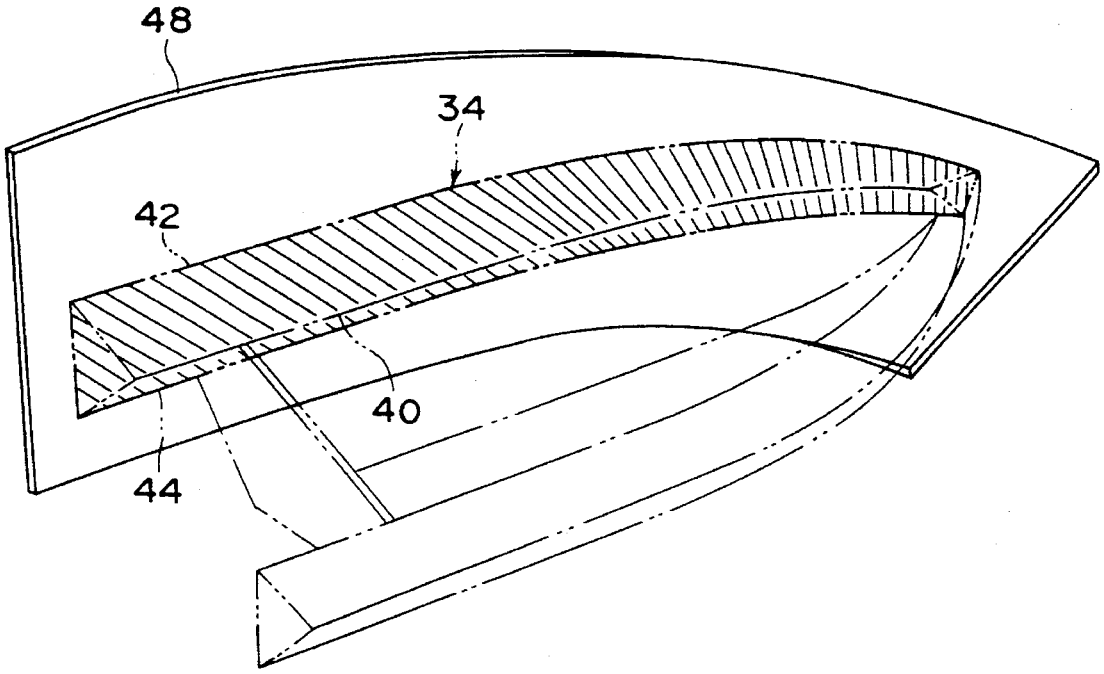
FIG. 9 is a perspective view illustrating a state in which a flat plate is spread on the jig.

Next, a cutting pattern 46 is made by using the jig 34. Specifically, as illustrated in FIG. 9, a flat plate 48 which is shaped as a rectangular, flat plate (note that the flat plate 48 is not necessarily rectangular) is spread on one of the three surfaces of the jig 34 which are formed so as to connect adjacent ridge lines of the three ridge lines. At this time, the flat plate 48 is spread on the jig 34 so as to fit closely to a pair of ridge lines (to the connecting poles 42, 44 in the drawing). In FIG. 9, in order to more easily visualize the state in which the flat plate 48 is spread, a pair of jigs 34 and the configuration of the rubber boat are illustrated. Accordingly, when the flat plate is actually spread only the jig 34 exists. Further, in the figure, the range illustrated by the hatched lines is the range surrounded by the four edge lines including the pair of ridge lines (the connecting poles 42, 44) of the jig 34. i.e., the range illustrated by the hatched lines is one surface of the jig 34. In this way, the flat plate 48 spread on the jig 34 is a quadric surface and a surface which can be spread out. A thin, flexible steel plate or the like may be used for the flat plate 48.

Figure 10:
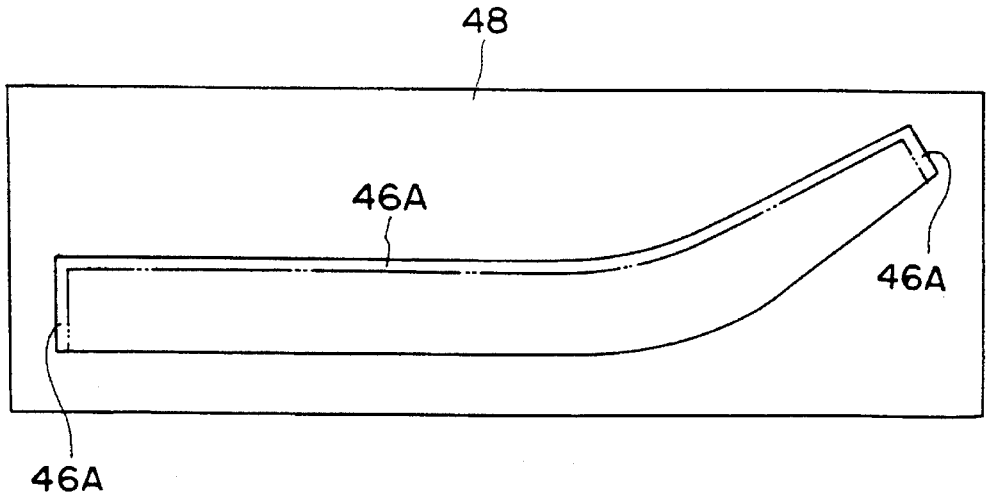
FIG. 10 is a plan view illustrating a state in which the flat plate is spread out In planar form from the state illustrated in FIG. 9.
Figure 11:
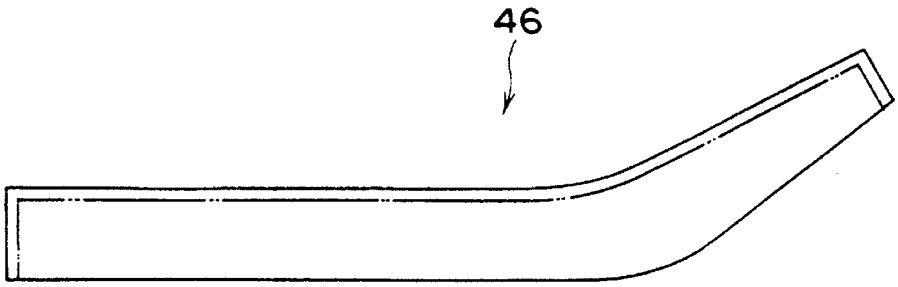
FIG. 11 is a plan view of a cutting pattern which is cut from the flat plate illustrated in FIG. 10.

Next, in the state shown in FIG. 9, the four edge lines which include the pair of ridge lines (tile connecting poles 42, 44) of the jig 34 are copied onto the flat plate 48. Thereafter, the flat plate 48 is removed from the jig 34, and is spread in planar form as shown in FIG. 10. After the flat plate 48 has been spread out, a laminating region 46A of a predetermined width is drawn at the peripheries of three of the four copied edge lines (i.e., at the peripheries of all of the copied edge lines except for the bottom edge line as illustrated in FIG. 10). Next, when the flat plate 48 is cut along the laminating region 46A, the cutting pattern 46 illustrated in FIG. 11 is obtained.

Figure 12:
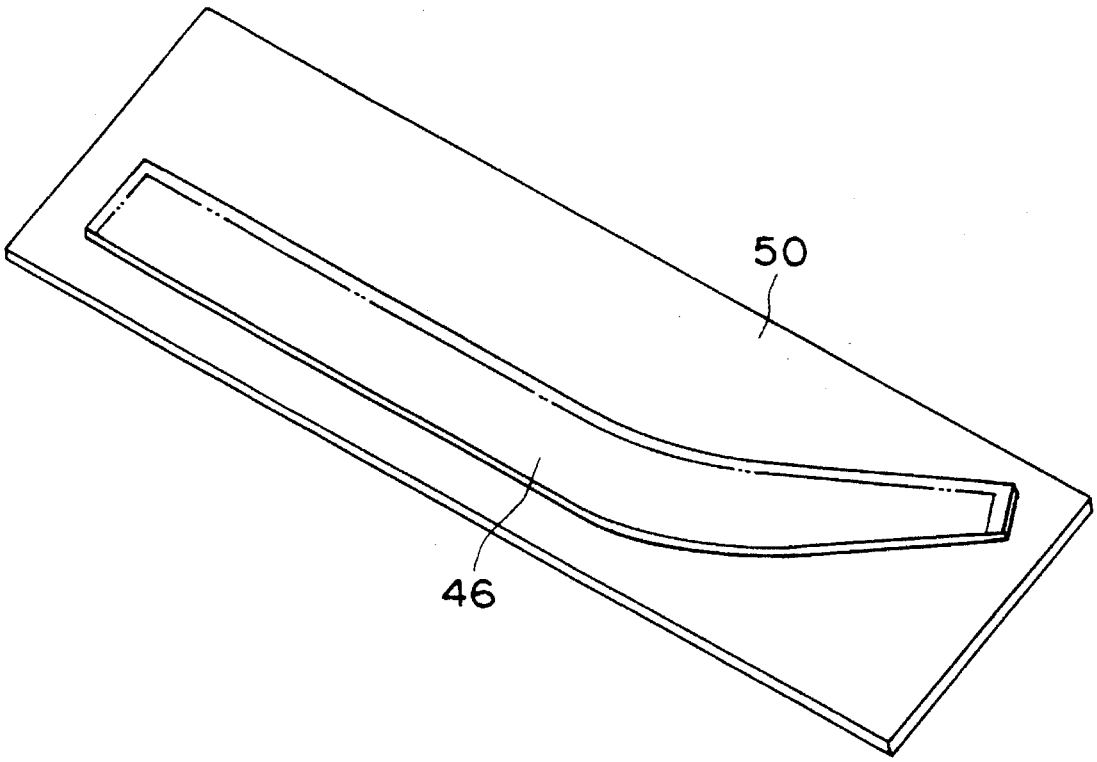
FIG. 12 is a perspective view illustrating a state in which the cutting pattern is placed on a sheet material.

Subsequently, as illustrated in FIG. 12, the cutting pattern 46 is placed on the sheet material 50, and the sheet material 50 is cut along the cutting pattern 46. The above-described series of operations is carried out for each of the three surfaces of the jig 34. The sheet materials 30A, 30B, 30C are obtained by this cutting of the sheet material 50.

Thereafter, the resultant three sheet materials 30A, 30B, 30C are adhered together at the laminating regions such that the ridge lines are shared by the sheet materials 30A, 30B, 30C. Finally, the circular sheet material 30D is also adhered. In this way, the tube 30, which has the substantially triangular column configuration and which curves smoothly and three-dimensionally and which runs along the central line CL, is obtained. The tube 30 at the opposite side can be obtained by turning the above-described tube 30 inside-out.

Next, the processes for expanding the tube 30 will be described.

When compressed air or the like is fed into the tube 30 which has been spread out in planar form from its collapsed state, the tube 30 begins to expand along the central line CL which is the intended predetermined three-dimensional curve. When the expansion reaches a certain degree, the tube 30 assumes a substantially equilateral polygonal column configuration (the fabricated configuration (Q)). When the tube 30 is expanded even more, the shape thereof is changed into a substantially cylindrical configuration (the intended expanded configuration (P)).

This phenomenon will be explained with respect to an arbitrary orthogonal cross-section which is orthogonal to the central line CL. In FIG. 5, the intermediate portion of each side of the equilateral triangle T which portions are positioned inside the circumference S (i.e., portions corresponding to chords when the circumference S is taken as a reference) expand toward the circumference S as the internal pressure of the tube 30 increases. Simultaneously, the portions of the vertical angles A, B, C of the equilateral triangle T which portions are positioned outside the circumference S are pulled in so as to cave in toward the center O. When the internal pressure exceeds a predetermined value, the equilateral triangle T changes into the circumference S. This expansion process occurs at all of the arbitrary orthogonal cross-sections. As a result, the intended expanded configuration (P) of the tube 30 which curves smoothly and three-dimensionally reemerges.

In the present embodiment, the fabricated configuration (Q) is made by considering the intended expanded configuration (P) which is a substantially cylindrical configuration which is equivalent to the substantially equilateral triangular column configuration of the fabricated configuration (Q). Therefore, the tube 30 of the rubber boat 10 which tube 30 is a substantially cylindrical configuration having the intended three-dimensional curve as the central line thereof, can be obtained in one set of operations without trial-and-error repetition. Accordingly, there is none of the complexity of the work involved in the fabrication method of the conventional art in which cylindrical and truncated cone-shaped tube elements are successively connected together. Further, no fold lines are formed at the connected portions. Therefore, workability can be improved, and the quality of the external appearance of the rubber boat 10 can also be improved.

In the present embodiment, the jig 34, in which the ridge lines of the substantially triangular column configuration which is the fabricated configuration (Q) are reproduced and which is used to obtain the cutting pattern 46 of the sheet material forming the tube 30, is contrived. Flat plates 48 are spread directly on the jig 34, and the cutting patterns 46 are prepared. Therefore, as compared with a case in which a computer is used to form cutting patterns, the present invention is simple and promotes cost reduction. This concept will be discussed more concretely hereinafter.

In a case in which the jig 34 is not used and each spread out surface is calculated by computer from the ridge lines of the substantially equilateral triangular column configuration, first, a pair of ridge lines are selected from the three ridge lines of the substantially equilateral triangular column, and a quadric surface including these ridge lines is calculated. Next, the planar configuration after spreading out is calculated from the quadric surface and the four edge lines including the selected pair of ridge lines. Thereafter, laminating regions are added to the determined planar configuration. The actual sheet configuration is determined and is used as the configuration of a cutting pattern.

In a case in which the above-described method is used, the following drawbacks occur. The quadric surface which includes the ridge lines is actually a torsional surface. As a result, due to this torsion, the equilateral triangular configurations at the tip end portion of the tube having the substantially equilateral triangular column configuration are also actually formed by incurring curves and swelling curves. Accordingly, it is necessary to remove this effect. In order to do so, either the end portion of the tube having the substantially equilateral triangular column configuration is extended and an equilateral triangle at infinity is imagined and the quadric surface is calculated, or the intersection of the respective ridge lines at infinity is imagined and the quadric surface is calculated. However, in order to imagine the equilateral triangle or the intersection at infinity and calculate the quadric surface, an extremely long calculation time is needed, as is the development of software particular to this use. Further, a large scale computer is needed, which is disadvantageous from the point of view of cost.

The above-described drawbacks occur when a computer is used. However, in accordance with the present invention, because the flat plates 48 are spread on the jig 34 in which the ridge lines are reproduced, the curves of the equilateral triangles at the tip end portion of the tube can be reproduced as they are in reality. Further, the quadric surfaces, which are surfaces which can be spread out, and the spread out planar configurations thereof can easily be obtained.

In the present embodiment, the fabricated configuration (Q) is a substantially equilateral triangular column configuration. However, the present invention is not limited to the same. Any configuration is applicable provided that it is a substantially equilateral polygonal column configuration (substantially equilateral quadrilateral column configuration, substantially equilateral pentagonal column configuration, substantially equilateral hexagonal column configuration, and the like).

In the present embodiment, the tube 30 is provided integrally with the side portion of the bottom portion 28 of the boat main body 12. However, the present invention is not limited to the same, and the tube 30 may be structured so as to be attachable to and removable from the boat body.

In the present embodiment, although the respective rear end portions of the left and right tubes 30 are not connected, they may be connected in the same way as at the bow side. Further, the tube 30 may be used as the tube for a kayak as well.

When the jig of the second aspect of the present invention is considered as a device invention, there is provided a jig for fabricating cutting patterns for a tube which cutting patterns are used in fabricating a tube for a rubber boat which tube is provided at the periphery of a rubber boat and whose intended expanded configuration having a three-dimensional curve as a central line is a substantially cylindrical configuration, wherein a fabricated configuration of tile tube for a rubber boat is a substantially equilateral polygonal column configuration formed by preparing equilateral polygons which are the same as circumferential lengths of the intended expanded configuration in a plurality of cross-sections orthogonal to the central line, and for each of which distances from the respective vertices thereof to the central line are equal, and by connecting corresponding sides of equilateral polygons of adjacent orthogonal cross-sections among the plurality of orthogonal cross-sections, wherein the jig has supporting bodies which follow substantially the same loci as ridge lines of the substantially equilateral polygonal column configuration.

When the second aspect of the present invention is considered as a method of fabricating cutting patterns for a tube, and not as a method of fabricating a tube for a rubber boat, there is provided a method of fabricating cutting patterns for a tube comprising the steps of: preparing a jig in which a plurality of ridge lines of a substantially equilateral polygonal column configuration is reproduced, for a tube for a rubber boat which is provided at the periphery of a rubber boat and whose intended expanded configuration having a three-dimensional curve as a central line is a substantially cylindrical configuration and whose fabricated configuration is the substantially equilateral polygonal column configuration formed by preparing equilateral polygons which are the same as circumferential lengths of the intended expanded configuration in a plurality of cross-sections orthogonal to the central line, and for each of which distances from the respective vertices thereof to the central line are equal, and by connecting corresponding sides of equilateral polygons of adjacent orthogonal cross-sections among the plurality of orthogonal cross-sections; and copying configurations of respective surfaces of a plurality of surfaces, which are respectively formed by connecting a pair of adjacent ridge lines of the plurality of ridge lines, onto the plate members so as to form cutting patterns corresponding to respective surfaces of a plurality of surfaces forming the tube, by placing flexible plate members at the respective surfaces of the plurality of surfaces respectively formed by connecting a pair of adjacent ridge lines.

As described above, even if the second aspect of the invention is considered as a method of fabricating cutting patterns for a tube, the same operation and effects as those of the second aspect can be obtained.

In the tube for a rubber boat relating to the first aspect of the present invention described above, the fabricated configuration, in a case in which a substantially cylindrical configuration having a predetermined three-dimensional curve as the center line thereof is the intended expanded configuration, is a substantially equilateral polygonal column configuration formed by connecting a plurality of equilateral polygons having the same central line and for which the sum totals of the lengths of the respective sides thereof are substantially equal to circumferential lengths of an intended expanded configuration at appropriate orthogonal cross-sections on the central line. Therefore, superior effects are achieved in that a three-dimensional curved configuration is realized, and workability and the quality of the external appearance can be improved.

In the method of fabricating a tube for a rubber boat relating to the second aspect of the present invention, cutting patterns of a sheet material forming the tube are formed by using a jig in which the ridge lines of a substantially equilateral polygonal column configuration, which is the fabricated configuration of the tube for a rubber boat of the first aspect of the present invention, are reproduced. Because the tube for the rubber boat is fabricated through this process, a superior effect is achieved in that the method is more expedient and less expensive than a case in which the cutting patterns of the sheet material are obtained by using a computer.

What is claimed is:

1. A flexible, expandable tube for a rubber boat adapted to be provided at the periphery of the boat and whose intended expanded configuration, having a three-dimensional curve as a central line, is a substantially cylindrical configuration, said tube being constructed and arranged such that a fabricated configuration of said tube is a polygon column configuration formed by a plurality of polygonal cross-sections orthogonal to said center line, each of said polygonal cross-sections having a peripheral dimension generally equal to a circumferential dimension of a corresponding cross-section of said expanded configuration of said tube, and for each of said polygonal cross-sections, distances from the respective vertices thereof to said central line are substantially equal, said polygonal cross-sections being connected in such a manner that expansion of said fabricated configuration of said tube results in said substantially cylindrical, expanded configuration of said tube.

2. A tube for a rubber boat according to claim 1, wherein said polygonal column configuration is a substantially equilateral polygonal column configuration, and said polygons are substantially equilateral polygons.

3. A tube for a rubber boat according to claim 2, wherein said tube for a rubber boat is formed from a plurality of sheet materials which are provided so as to correspond respectively to a plurality of side surfaces of said substantially equilateral polygonal column configuration.

4. A tube for a rubber boat according to claim 2, wherein each surface of said substantially equilateral polygonal column configuration is formed as a quadric surface which can be copied onto a single plate member.

5. A tube for a rubber boat according to claim 2, further comprising:

a tube closing member which, when said tube is in an unconnected state at a stern direction end portion of said rubber boat, is provided at an end portion of said tube and closes said tube.

6. A method of fabricating an expandable tube for a rubber boat comprising the steps of:

preparing a jig in which a plurality of ridge lines of a polygonal column configuration is reproduced, for the tube which is adapted to be provided at the periphery of the rubber boat and whose intended expanded configuration having a three-dimensional curve as a central line is a substantially cylindrical configuration and whose fabricated configuration is said polygonal column configuration formed by a plurality of polygonal cross-sections orthogonal to said center line, each of said polygonal cross-sections having a peripheral dimension generally equal to a circumferential dimension of a corresponding cross-section of said expanded configuration of said tube, and for each of said polygonal cross-sections, distances from the respective vertices thereof to said central line are substantially equal, and corresponding sides of polygons of adjacent orthogonal cross-sections are connected among said plurality of orthogonal cross-sections; the method including:

forming cutting patterns for a plurality of sheet members which respectively correspond to a plurality of surfaces forming said tube by placing a flexible plate member at each surface of a plurality of surfaces which respectively are formed by connecting a pair of adjacent ridge lines among the plurality of ridge lines of said jig;

cutting said plurality of sheet members from a sheet material by using said cutting patterns for said plurality of sheet members; and adhering said plurality of sheet members together to form said fabricated configuration of said tube, which, when expanded, defines said expanded configuration of said tube.

7. A method of fabricating a tube for a rubber boat according to claim 6, wherein said polygonal column configuration is a substantially equilateral polygonal column configuration, and said polygons are substantially equilateral polygons.

8. A method of fabricating a tube for a rubber boat according to claim 6, wherein said jig has supporting bodies, connecting rods, and a central shaft which follows substantially the same locus as said central line, and the plurality of ridge lines are formed by said supporting bodies and said connecting rods.

9. A method of fabricating a tube for a rubber boat according to claim 6, wherein said forming of said cutting patterns for said plurality of sheet members is effected by spreading said plate members into planar forms.

10. A method of fabricating a tube for a rubber boat according to claim 7, wherein said forming of said cutting patterns for said plurality of sheet members is effected by copying configurations of respective surfaces of said plurality of surfaces onto said plate members.

11. A method of fabricating a tube for a rubber boat according to claim 10, wherein said forming of said cutting patterns for said plurality of sheet members is effected by drawing laminating portions of predetermined widths on said plate members at the copied configurations of the respective surfaces of said plurality of surfaces.

12. A method of fabricating a tube for a rubber boat according to claim 11, wherein said forming of said cutting patterns for said plurality of sheet members is effected by cutting said plate members along outer peripheries of the copied configurations including said laminating portions.

13. A method of fabricating a tube for a rubber boat according to claim 7, wherein said cutting of said plurality of sheet members is effected by superposing said cutting patterns for said plurality of sheet members on said sheet material and cutting said sheet material along outer peripheries of said cutting patterns for said plurality of sheet members.

14. A method of fabricating a tube for a rubber boat according to claim 7, wherein said plate members are formed from steel plates.

15. A jig for fabricating cutting patterns for a tube which cutting patterns are used in fabricating a tube for a rubber boat which tube is adapted to be provided at the periphery of a rubber boat and whose intended expanded configuration having a three-dimensional curve as a central line is a substantially cylindrical configuration, wherein a fabricated configuration of said tube is a polygonal column configuration formed by a plurality of polygonal cross-sections orthogonal to said center line, each of said polygonal cross-sections having a peripheral dimension generally equal to a circumferential dimension of a corresponding cross-section of said expanded configuration of said tube and for each of said polygonal cross-sections, distances from the respective vertices thereof to said central line are substantially equal, said polygonal cross-sections being connected, wherein said jig has supporting bodies which follow substantially the same loci as ridge lines of said polygonal column configuration.

16. A jig according to claim 15, wherein said polygonal column configuration is a substantially equilateral polygonal column configuration, and said polygons are substantially equilateral polygons.

17. A jig according to claim 16, further comprising:

connecting rods and a central shaft which follows substantially the same locus as said central line, said ridge lines being formed by said supporting bodies and said connecting rods.

18. A jig according to claim 16, wherein the loci of said supporting bodies are formed such that each surface, which includes adjacent supporting bodies and which is formed so as to correspond to a surface of said substantially equilateral polygonal column configuration, is a quadric surface which can be copied onto a single plate member.

19. A method of fabricating cutting patterns for a tube comprising the steps of:

preparing a jig in which a plurality of ridge lines of a polygonal column configuration is reproduced, for a tube for a rubber boat which is adapted to be provided at the periphery of a rubber boat and whose intended expanded configuration having a three-dimensional curve as a central line is a substantially cylindrical configuration and whose fabricated configuration is said polygonal column configuration formed a plurality of polygonal cross-sections orthogonal to said center line, each of said polygonal cross-sections having a peripheral dimension generally equal to a circumferential dimension of a corresponding cross-section of expanded configuration of said tube and for each of said polygonal cross-sections, distances from the respective vertices thereof to said central line are substantially equal, said polygonal cross-sections being connected the method including:

copying configurations of respective surfaces of a plurality of surfaces, which are respectively formed by connecting a pair of adjacent ridge lines of the plurality of ridge lines, onto said plate members so as to form cutting patterns corresponding to respective surfaces of a plurality of surfaces forming said tube, by placing flexible plate members at the respective surfaces of said plurality of surfaces respectively formed by connecting a pair of adjacent ridge lines.

20. A method of fabricating cutting patterns for a tube according to claim 19, wherein said polygonal column configuration is a substantially equilateral polygonal column configuration, and said polygons are substantially equilateral polygons.

21. A method of fabricating cutting patterns for a tube according to claim 20, wherein said copying onto said plate members is effected by additionally drawing on said plate members laminating portions of predetermined widths at the copied configurations.

22. A method of fabricating cutting patterns for a tube according to claim 21, further comprising the step of:

cutting said plate members, on which the configurations of the respective surfaces of said plurality of surfaces have been copied, along outer peripheries of the copied configurations including said laminating portions.

23. A method of fabricating cutting patterns for a tube according to claim 22, wherein said cutting of said plate members is effected by spreading said plate members in planar forms.

24. A method of fabricating cutting patterns for a tube according to claim 20, wherein said plate members are formed from steel plates.

* * * * *